US005947715A

United States Patent [19]

Sheng et al.

[11] Patent Number: 5,947,715

[45] Date of Patent: Sep. 7, 1999

[54] SAFETY LIGHTER

[76] Inventors: Andy Sheng; Betty Sheng, both of P.O. Box 4268, Cerritos, Calif. 90703

[21] Appl. No.: 09/083,207

[22] Filed: Jan. 9, 1998

[51] Int. Cl.[6] ..... F23D 11/36

[52] U.S. Cl. ..... 431/153

[58] Field of Search ..... 431/153

[56] References Cited

U.S. PATENT DOCUMENTS

| | | | |
|---|---|---|---|
| 5,165,886 | 11/1992 | Frigiere | 431/153 |
| 5,407,346 | 4/1995 | Sher | 431/153 |
| 5,421,720 | 6/1995 | Sher | 431/153 |

*Primary Examiner*—Carroll B. Dority
*Attorney, Agent, or Firm*—David & Raymond; Raymond Y. Chan

[57] ABSTRACT

A safety lighter includes a fuel tank capped by a cover seat which has a fuel releasable valve communicated therethrough, a fuel lever mounted on said cover seat for operating a fuel pipe provided by the fuel releasable valve, and a flint wheel assembly adjacent the fuel lever having a flint wheel for producing spark. The cover seat has a recess subjacent the depressable platform. A blocking projection is protruded on the depressable platform underside. A catch handle comprises an insert leg vertically received in the recess and a handle extended horizontally subjacent the depressable platform of the fuel lever. The handle has a perforation into which the projection on the depressable platform is allowed to pass through. A resilient element is received in the recess and props against the insert leg for pushing the handle outwards to maintain in a lock-up position, wherein the blocking projection underside the depressable platform is positioned just adjacent to the perforation on the handle of the catch handle to prevent inadvertent fuel release unless the depressable platform is forcely depress until the blocking projection is inserted into the perforation of the handle by pushing the catch handle inwardly.

13 Claims, 7 Drawing Sheets

SAFETY LIGHTER

CROSS REFERENCE OF RELATED APPLICATION

This application is an improvement of a utility application, Ser. No. 08/947,962, filed Oct. 9, 1997 by the inventors of this application and now U.S. Pat. No. 5,836,755.

FIELD OF THE PRESENT INVENTION

The present relates to disposable lighter, and more particularly to a safety lighter having a fuel lever locking device for normally locking the fuel lever to prevent inadvertent fuel release and actuation by children. Moreover, the ignition of the safety lighter of the present invention requires a simple single-action operation by adult instead of the double-action operation.

BACKGROUND OF THE PRESENT INVENTION

Conventional disposable lighter generally comprises a fuel tank capped by a cover seat which has a fuel releasable valve communicated therethrough, a fuel lever mounted on the cover seat for operating a fuel pipe provided by the fuel releasable valve, and a flint wheel assembly adjacent the fuel lever having a flint wheel for producing spark when the flint wheel is rotated against a flint subjacent the flint wheel to ignite the fuel released through the fuel releasable valve when the fuel lever is simultaneously depressed to lift the fuel pipe.

Although the conventional disposable lighters are extensively used and extremely convenient, they are prone to some incidents of inadvertent fuel release. In fact, the fuel, commonly butane, stored in the fuel tank is under predetermined pressure, therefore the fuel may escape as gas to the environment when vented through the fuel releasable valve. This presents some risks of inadvertent ignition. Moreover, the conventional disposable lighters are operable to children. Over 30% of home fire in United States is caused by the inadequate and inadvertent operation of lighters by children.

After Jul. 1, 1994, attention has been directed to prevent ready actuation of the lighters by children who are normally not able to appreciate the potential danger of the flame. Although various safety lighters have been devised, such as U.S. Pat. Nos. 5,074,781; 5,165,886; 5,224,854; 5,240,408; 5,242,297; 4,687,437; 4,758,152; and 4,830,603, they are somewhat difficult in operation and manufacture.

The lockable lighter of the related application comprises a fuel lever lockable device for normally locking the fuel lever in a lock-up position to prevent inadvertent fuel release and actuation of children unless it is manipulated to a release position for permitting the fuel lever to function. However, in order to ignite the lighter, the user must operate the catch handle to a release position, in which the handle of the catch handle is pushed inward for aligning the perforation on the handle with the blocking projection underside the depressable platform, in which the handle is lifted up until the blocking projection penetrating through the perforation. In this release position, the fuel lever is depressable to allow fuel release through the fuel releasable valve. Then, the user must further turn the flint wheel to rotate and depress the depressable platform in order to ignite the lighter. In other words, two actions are required to complete the ignition of the lockable lighter.

SUMMARY OF THE PRESENT INVENTION

The main object of the present invention is to provide a safety lighter which comprises a fuel lever locking device for normally locking the fuel lever in a lock-up position to prevent inadvertent fuel release and actuation by children. However, only a simple single-action is needed to manipulate the fuel lever locking device to a release position and ignite the lighter simultaneously.

Another object of the present invention is to provide a safety lighter in which the fuel lever locking device is more easy to operate and manufacture with less parts.

Accordingly, the above mentioned objects are accomplished in the present invention by providing a safety lighter comprising a fuel tank capped by a cover seat which has a fuel releasable valve communicated therethrough, a fuel lever which has a depressable platform and is mounted on a supporting frame affixed on the cover seat for operating a fuel pipe provided by the fuel releasable valve, and a flint wheel assembly adjacent the fuel lever having a flint wheel for producing spark when the flint wheel is rotated against a flint subjacent the flint wheel to ignite the released through the fuel releasable valve when the depressable platform of the fuel lever is simultaneously depressed to lift the fuel pipe.

The cover seat has a recess subjacent the depressable platform. A blocking projection is protruded downwardly from the depressable platform underside. The blocking projection has an inclined bottom tip. A catch handle comprises an insert leg vertically received in the recess and a handle extended horizontally subjacent the depressable platform of the fuel lever. The handle has a perforation into which the projection on the depressable platform is allowed to pass through. The perforation has an inclined inner wall so that a top size of the perforation is larger than a bottom size of the perforation. A resilient element is received in the recess and props against the insert leg for pushing the handle outwards to maintain in a lock-up position, wherein the blocking projection underside the depressable platform is positioned just adjacent to the perforation on the handle of the catch handle.

Therefore, in such lock-up position, the blocking projection is blocked by the periphery surface of the perforation and is unable to be depressed downwards to prevent inadvertent fuel release and actuation by children. When an adult user turns the flint wheel and then downwardly applies a predetermined depress force on the depressable platform, the blocking projection will force to insert into the perforation on the handle and push the catch handle inwardly to compress the resilient element. When the depressing force applied on the depressable platform of the fuel lever is released, the resilient element will prop and push the catch handle outwards to its original lock-up position automatically.

DETAILED DESCRIPTION OF THE PREFERRED EMBODIMENT

Figure 1:
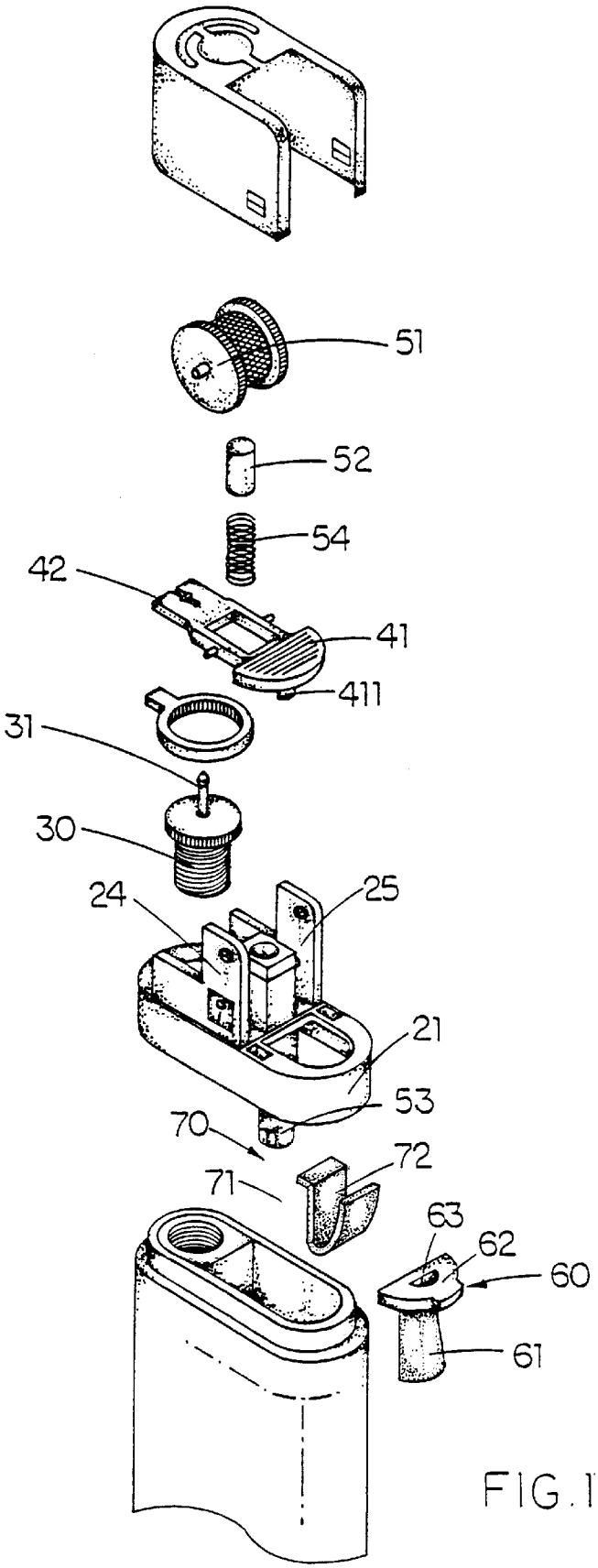
FIG. 1 is an exploded perspective view of a safety lighter according to a first preferred embodiment of the present invention.
Figure 2:
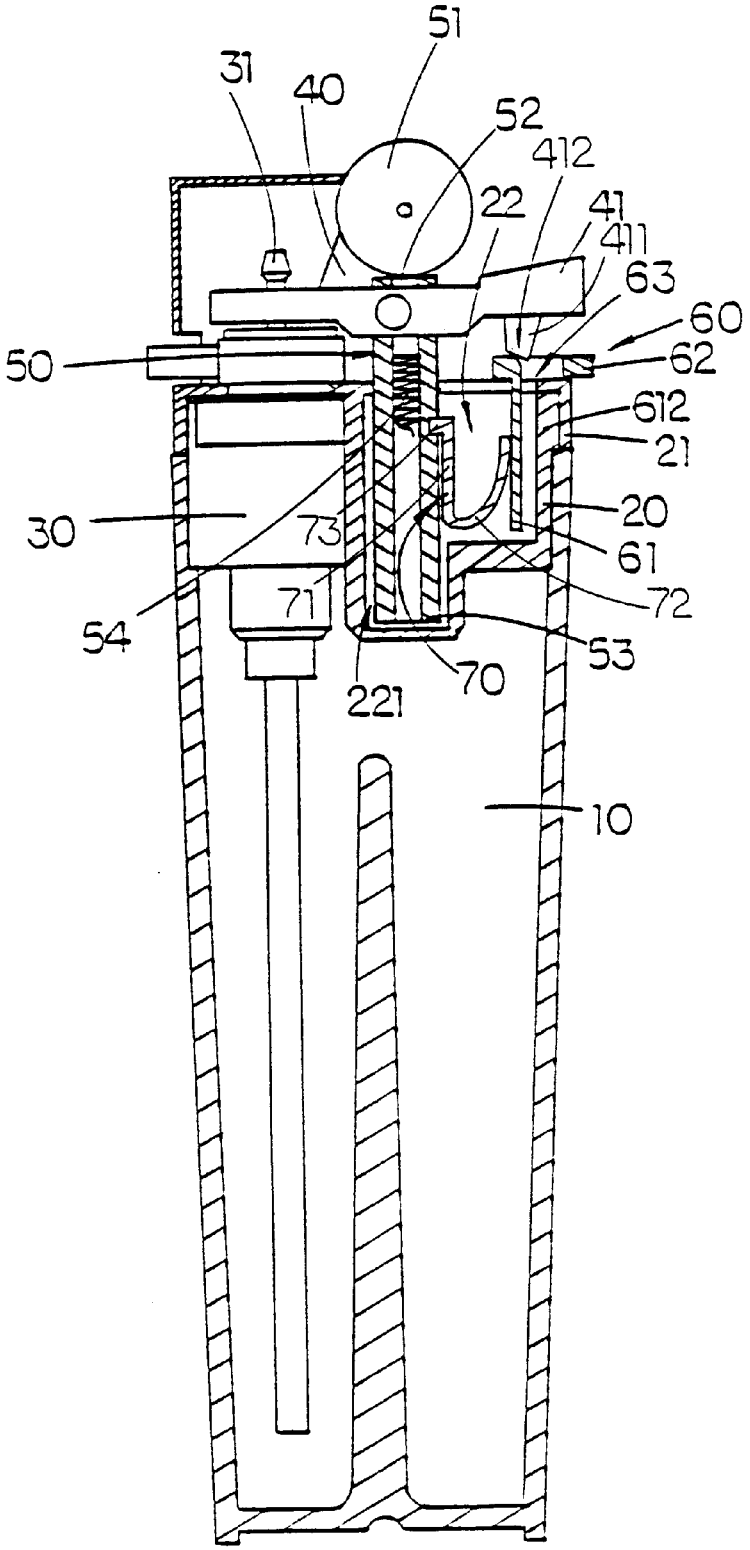
FIG. 2 is a sectional end view of the safety lighter in its lock-up position according to the above first preferred embodiment of the present invention.
Figure 3:
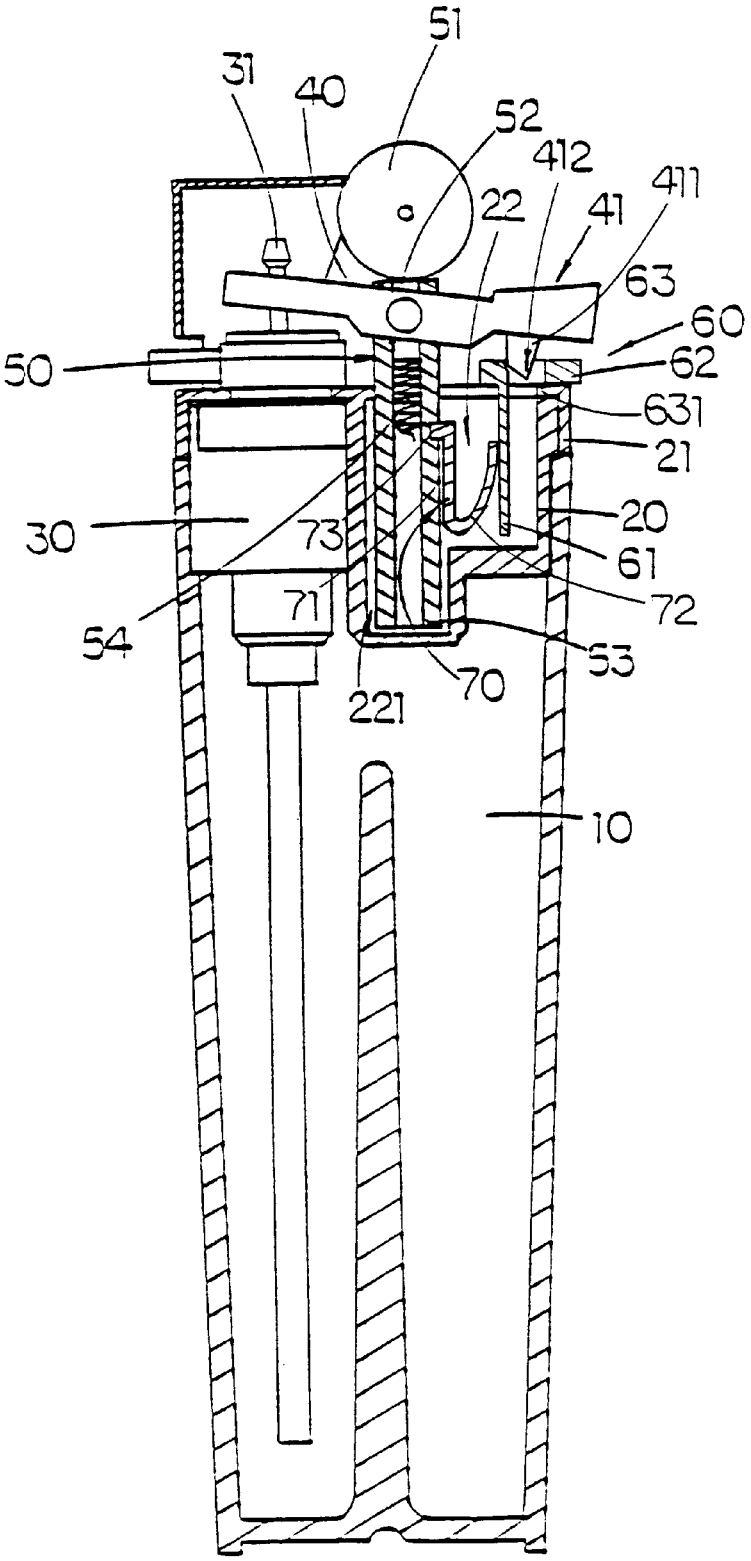
FIG. 3 is a sectional end view of the safety lighter in its ignition condition according to the above first preferred embodiment of the present invention.

Referring to FIGS. 1 to 3 of the drawings, a safety lighter according to a preferred embodiment of the present invention comprises a fuel tank 10 capped by a cover seat 20 which has a fuel releasable valve 30 communicated therethrough, a fuel lever 40 which has a depressable platform 41 and is mounted on a supporting frame 21 affixed on the cover seat 20 for operating a fuel pipe 31 provided by the fuel releasable valve 30, and a flint wheel assembly 50 adjacent the fuel lever 40 having a flint wheel 51, which is rotatably mounted on the supporting frame 21, for producing spark when the flint wheel 51 is rotated against a flint 52 subjacent the flint wheel 51 to ignite the fuel released through the fuel releasable valve 30 when the depressable platform 41 of the fuel lever 40 is simultaneously depressed to lift the fuel pipe 31.

The cover seat 20 has a recess 22 subjacent the depressable platform 41. The recess 22 is divided into an inner deeper flint chamber 221 and an outer leg chamber 222. The flint wheel assembly 50 further comprises a flint tube 53, which is received in the flint chamber 22 of the recess 22, to receive a spring 54 and the flint 52, in which the flint 52 is supported by the spring 54 to prop against the flint wheel 51.

The fuel lever 40 is pivotally mounted on two parallel supporting walls 24, 25 protruded on two opposite sides of the cover seat 20. The flint wheel 51 is also rotatably mounted between the two supporting walls 24, 25. One engaging end 42 of the fuel lever 40 is engaged with the fuel pipe 31, so that when the depressable platform 41 of the fuel lever 40 is depressed, the engaging end 42 of the fuel lever 40 lifts the fuel pipe 31 for releasing fuel.

A blocking projection 411 is protruded on the depressable platform 41 underside. The safety lighter of the present embodiment further comprises a L-shaped catch handle 60 which comprises an insert leg 61 vertically extended and received in the recess 22 and a handle 62 extended horizontally subjacent the depressable platform 41 of the fuel lever 40. The handle 62 is a semi-circular plate and has a size generally conformed to the depressable platform 41 of the fuel lever 40. The handle 62 has a perforation 43 into which the projection 411 on the depressable platform 41 is allowed to pass through. The blocking projection 411 has a height slightly shorter than a distance between the bottom side of the depressable platform 41 and the top surface of the handle 62.

The safety lighter further comprises a resilient element 70 received in the recess 22. The resilient element 70 according to the present embodiment is a generally V-shaped leaf spring made of metal or plastic. The resilient element 70 comprises a supporting piece 71 abutting against the flint tube 53 and a pressing piece 72 propping against the insert leg 61 of the catch handle 60 for pushing the handle 62 outwards to maintain in a lock-up position, in which blocking projection 411 underside the depressable platform 40 is positioned just adjacent to the perforation 63 on the handle 62 of the catch handle 60. In order to more firmly mount the resilient element 70 in position, a top end of the supporting piece 71 provides a horizontally extending end protrusion 73 to engage with a wall of the flint tube 53.

Accordingly, in such lock-up position, as shown in FIG. 2, the blocking projection 411 is blocked by a periphery surface 621 of the perforation 63 on the handle 62, so that the blocking projection 411 is locked to prevent being depressed inadvertently or being depressed by children who do not have enough force to drive the blocking projection 411 inserting into the perforation 63 and compress the resilient element 70.

In order to ensure that the blocking projection 411 would insert into the perforation 63 while an adult user depresses on the depressable platform 40, the blocking projection 411 is provided with a tapered or inclined bottom edge 412. Furthermore, the perforation 63 has a tapered or inclined inner wall 631, so that a top size of the perforation 63 is larger than a bottom size of the perforation 63. Therefore, when the depressable platform 40 is depressed, the blocking projection 411 is guided by its inclined bottom edge 412 and the inclined inner wall 631 to insert into the perforation 63 and push the insert leg 61 inwardly to compress the resilient element 70, as shown in FIG. 3.

To ignite the lighter, the adult user can simply turn the flint wheel 51 and then press on the depressable platform 41 downwardly, so that the catch handle 60 is forced to move inwardly by the blocking projection 411 until the perforation 63 on the handle 62 is aligned with the blocking projection 411 to enable the blocking projection 411 downwardly inserting into the perforation 63. In this ignition condition, the resilient element 70 is compressed by the inward movement of the insert leg 61 of the catch handle 60 and the fuel lever 40 is depressed to lift the fuel pipe 31 to allow fuel releasing through the fuel releasable valve 30.

When the depressing force applied on the depressable platform 41 of the fuel lever 40 is released, the resilient element 70 props and pushes the catch handle 60 outwards to its original lock-up position automatically, as shown in FIG. 2. In other words, the safety lighter of the present invention enables the fuel lever 40 normally maintained in the lock-up position to prevent inadvertent fuel release and actuation by children unless it is manipulated by an adult through a single-action operation to ignite the lighter.

Figure 4:
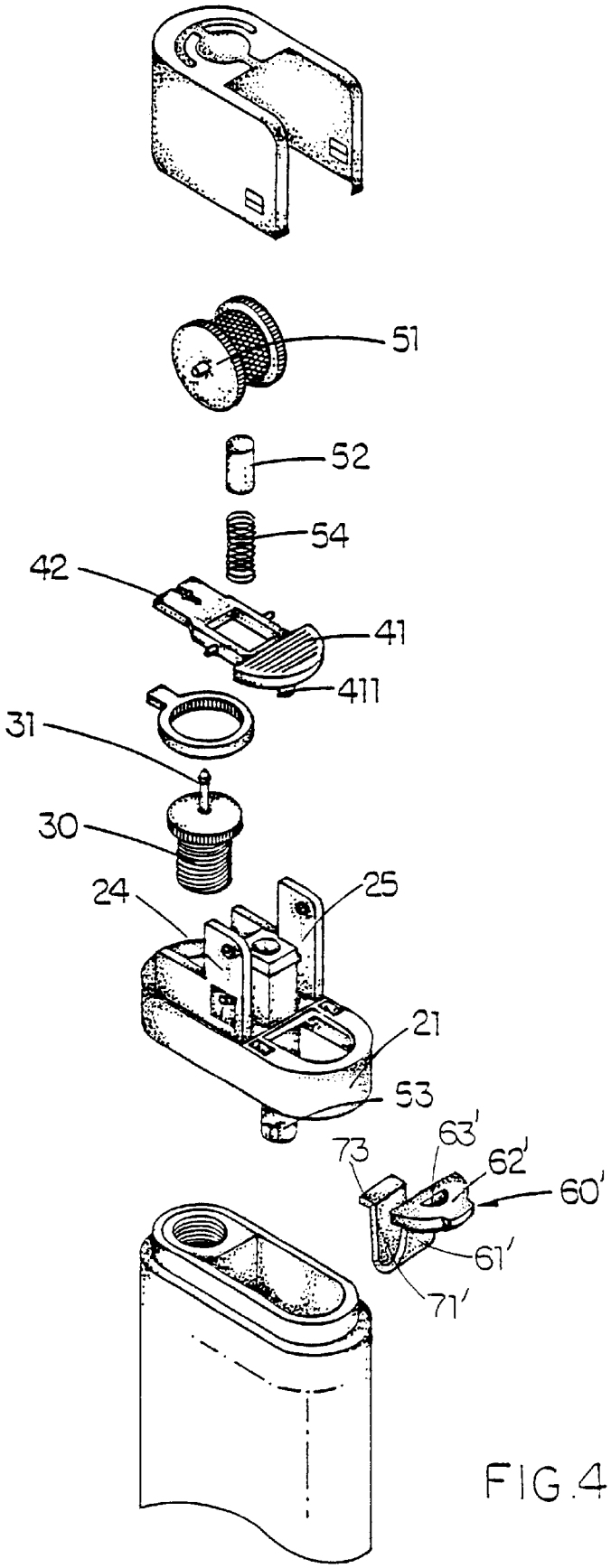
FIG. 4 is an exploded perspective view of a safety lighter according to a second preferred embodiment of the present invention.
Figure 5:
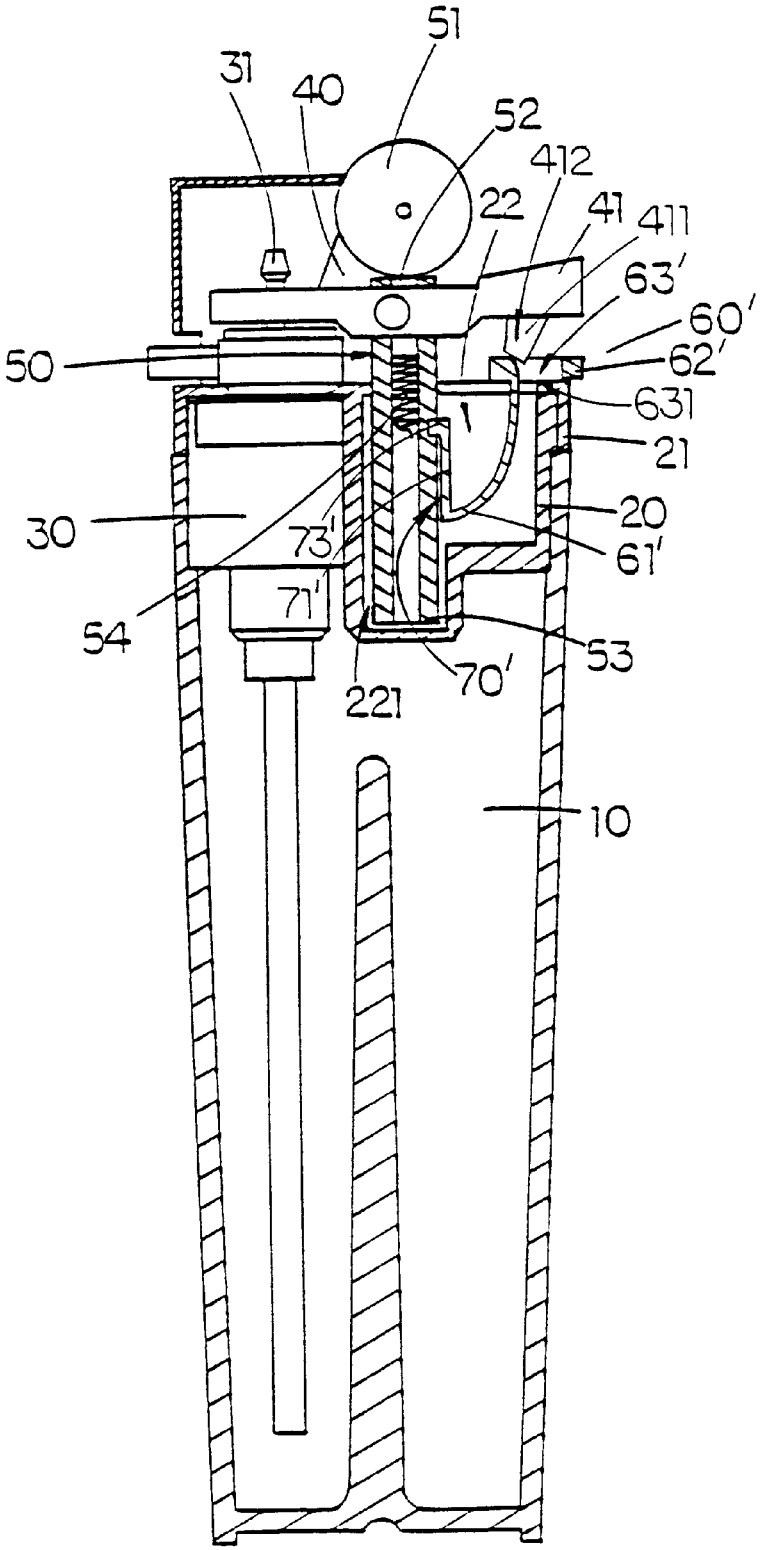
FIG. 5 is a sectional end view of the safety lighter in its lock-up position according to the above second preferred embodiment of the present invention.
Figure 6:
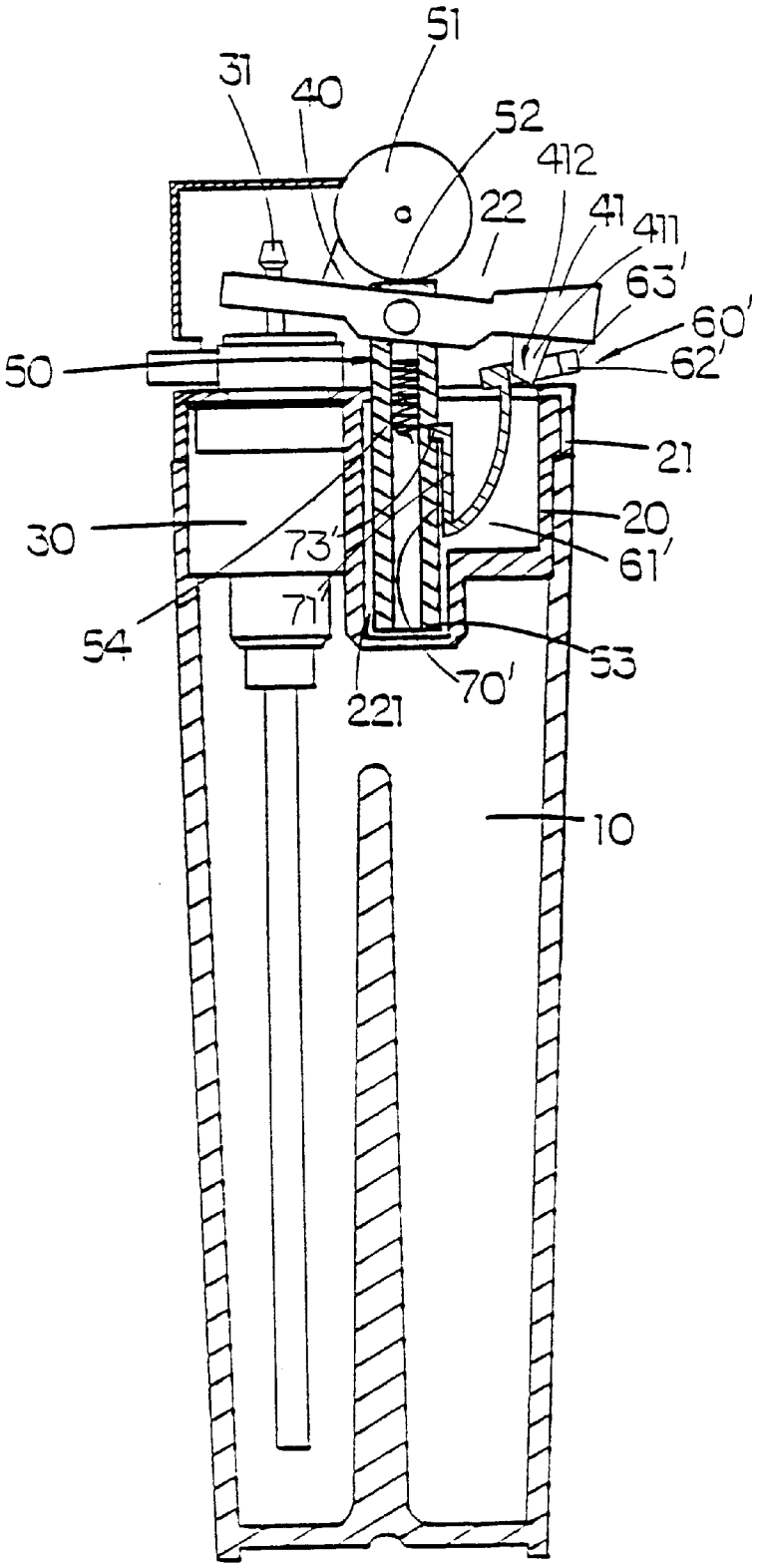
FIG. 6 is a sectional end view of the safety lighter in its actuation condition according to the above second preferred embodiment of the present invention.

Referring to FIGS. 4 to 6, a safety lighter according to a second preferred embodiment of the present invention is illustrated, which generally comprises the same configuration of the above first embodiment. The major modification of the second embodiment is that the insert leg 61 of the catch handle 60 is combined with the resilient element 70 to form an integral body. According to the second preferred embodiment, the catch handle 60' comprises an insert leg 61' which is extended downwardly and outwardly from a handle 62' to form a J shape member and a supporting piece 71' which is integrally and vertically extended upwardly from a bottom end of the insert leg 61'. The supporting piece 71' is abutted against the flint tube 53 inside the recess 22 and may also provide a top bent end protrusion 73' to engage with a wall of the flint tube 53, so that when the handle 62' is pushed inwardly by the downwardly depressed blocking projection 411 of the depressable platform 41 when the blocking projection 411 is inserted into the perforation 63' provided on the handle 62', as shown in FIG. 6, the supporting piece 71' supports the insert leg 61' to tend to return to its original lock-up position. Therefore, when the pushing force applied to the handle 62' releases, the handle 62' will return to its lock-up position as shown in FIG. 5.

Figure 7:
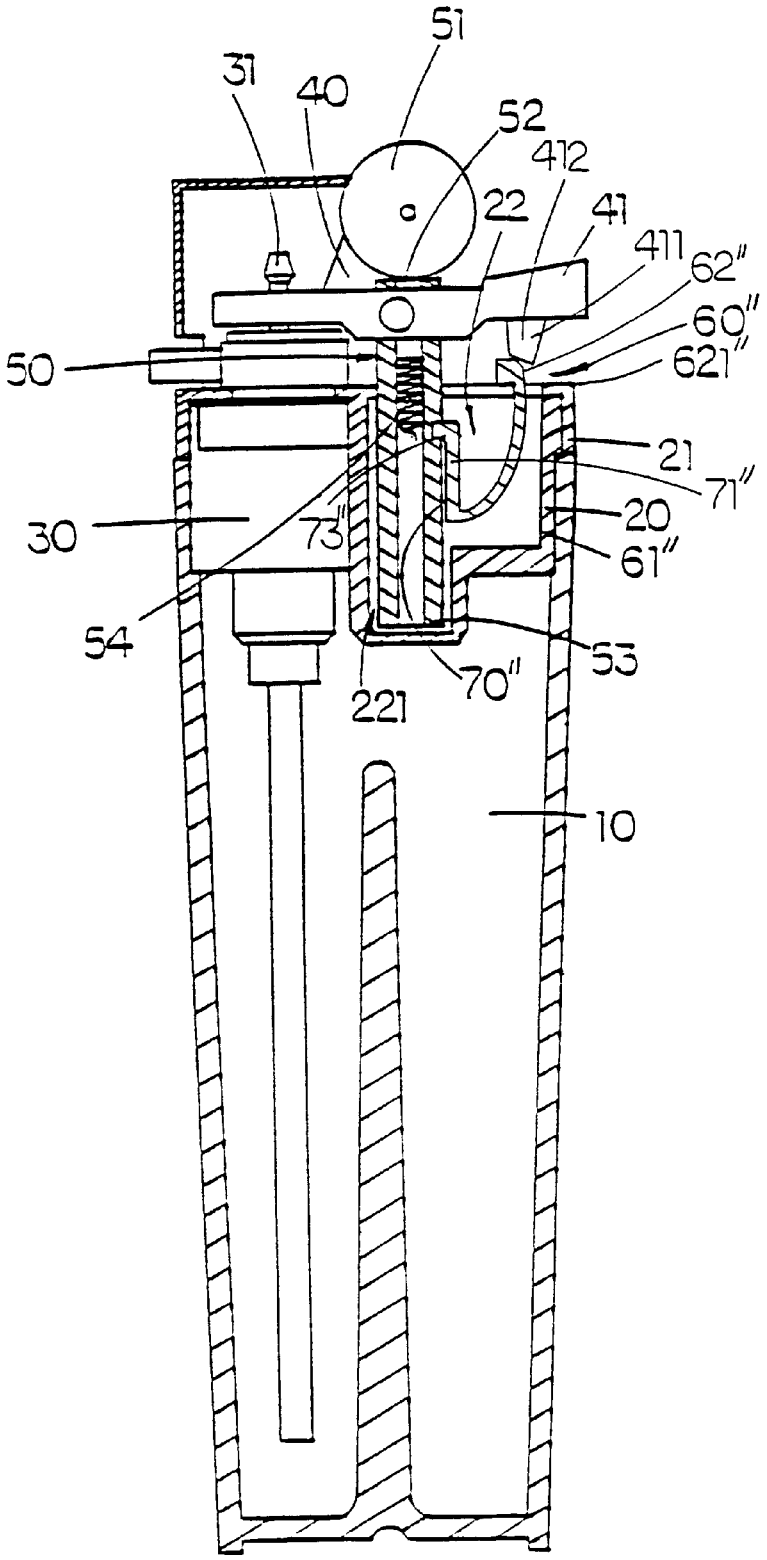
FIG. 7 is a sectional end view of a safety lighter according to a third preferred embodiment of the present invention.

FIG. 7 illustrates a safety lighter according to a third preferred embodiment which is an alternative mode of the above first and second embodiments of the present invention. The safety lighter of this third embodiment basically has the same configuration as the above first and second embodiments except the catch handle 60" which eliminates the handle 62 or 62' and simply comprises an insert leg 61" combined with the resilient element 70" to form an integral body. According to the third preferred embodiment, the insert leg 61" is extended downwardly to form a J shape member received in said recess 22. The resilient element 70" simply comprises a supporting piece 71" which is integrally and vertically extended upwardly from a bottom end of the insert leg 61". The supporting piece 71" is abutted against the flint tube 53 inside the recess 22 and may also provide a top bent end protrusion 73" to engage with a wall of the flint tube 53. A top end of the insert leg 61" is enlarged to form a blocking head 62" positioning below the blocking projection 411 of the depressable platform 41. The blocking head 62" has a tapered outer end 621" to guide the downward movement of the blocking projection 411.

Normally, the supporting piece 71" supports the catch handle 60" in its lock-up position to block the downwardly movement of the depressable platform 41 to prevent inadvertent fuel release and actuation by children. However, when the depressable platform 41 is forcely depressed downwards by an adult user, the blocking projection 411 will be forced to prop against the tapered outer end of said blocking head 62" and push the insert leg 61" to move inwardly. But, when the depressing force applied on said depressable platform 41 is released, the supporting piece 71" will support the insert leg 61" to return to its original lock-up position automatically.

What is claimed is:

1. A safety lighter, comprising a fuel tank capped by a cover seat which has a fuel releasable valve communicated therethrough, a fuel lever which has a depressable platform and is mounted on a supporting frame affixed on said cover seat for operating a fuel pipe provided by said fuel releasable valve, and a flint wheel assembly which is provided adjacent said fuel lever having a flint wheel for producing spark when said flint wheel is rotated against a flint positioned subjacent said flint wheel to ignite said fuel released through said fuel releasable valve while said depressable platform of said fuel lever is depressed to lift said fuel pipe, and that said cover seat has a recess provided subjacent said depressable platform;

a blocking projection being protruded from said depressable platform underside, said blocking projection having an inclined bottom edge;

a catch handle comprising an insert leg vertically extended and received in said recess and a handle extended horizontally subjacent said depressable platform of said fuel lever, said handle having a perforation into which said blocking projection on said depressable platform is allowed to pass through, moreover said perforation has an inclined inner wall so that a top size of said perforation is larger than a bottom size of said perforation; and a resilient element which is received in said recess for pushing said insert leg and said handle outwards to a lock-up position, wherein said inclined bottom edge of said blocking projection is positioned just adjacent to said inclined inner wall of said perforation of said depressable platform, so that said blocking projection is blocked by a periphery surface of said perforation on said handle and is unable to be depressed downwards to prevent inadvertent fuel release; moreover when said flint wheel is turned and said depressable platform is depressed downwardly by a depressing force to ignite said safety lighter, said catch handle is forced to move inwardly by said blocking projection until said perforation on said handle is aligned with said blocking projection to enable said blocking projection downwardly inserting into said perforation, and that said resilient element is compressed by an inward movement of said insert leg of the catch handle, and that when said depressing force applied on said depressable platform of said fuel lever is released, said resilient element props and pushes said catch handle outwards to said original lock-up position automatically.

2. A safety lighter as recited in claim 1 wherein said handle is a semi-circular plate and has a size generally conformed to said depressable platform of said fuel lever.

3. A safety lighter as recited in claim 1 wherein said resilient element which is a generally V-shaped leaf spring made of metal or plastic comprises a supporting piece abutting against said flint tube and a pressing piece propping against said insert leg of said catch handle for pushing said handle outwards to maintain in said lock-up position.

4. A safety lighter as recited in claim 2 wherein said resilient element which is a generally V-shaped leaf spring made of metal or plastic comprises a supporting piece abutting against said flint tube and a pressing piece propping against said insert leg of said catch handle for pushing said handle outwards to maintain in said lock-up position.

5. A safety lighter as recited in claim 3 wherein a top end of said supporting piece provides a horizontally extending end protrusion to engage with a wall of said flint tube.

6. A safety lighter as recited in claim 4 wherein a top end of said supporting piece provides a horizontally extending end protrusion to engage with a wall of said flint tube.

7. A safety lighter as recited in claim 1 wherein said insert leg is extended downwardly and outwardly from said handle to form a J shape member and said resilient element comprises a supporting piece integrally and vertically extended upwardly from a bottom end of said insert leg, said supporting piece being is abutted against said flint tube inside said recess the supporting piece to support said insert leg to tend to return to said original lock-up position thereof, therefore, when said pushing force applied to said handle is released, said supporting piece props said handle returning to said lock-up position.

8. A safety lighter as recited in claim 2 wherein said insert leg is extended downwardly and outwardly from said handle to form a J shape member and said resilient element comprises a supporting piece integrally and vertically extended upwardly from a bottom end of said insert leg, said supporting piece being is abutted against said flint tube inside said recess to support said insert leg to tend to return to said original lock-up position thereof, therefore, when said pushing force applied to said handle is released, said supporting piece props said handle returning to said lock-up position.

9. A safety lighter as recited in claim 7 wherein a top end of said supporting piece has a top bent end protrusion to engage with a wall of said flint tube.

10. A safety lighter as recited in claim 8 wherein a top end of said supporting piece has a top bent end protrusion to engage with a wall of said flint tube.

11. A safety lighter, comprising a fuel tank capped by a cover seat which has a fuel releasable valve communicated therethrough, a fuel lever which has a depressable platform and is mounted on a supporting frame affixed on said cover seat for operating a fuel pipe provided by said fuel releasable valve, and a flint wheel assembly which is provided adjacent said fuel lever having a flint wheel for producing spark when said flint wheel is rotated against a flint positioned subjacent said flint wheel to ignite said fuel released through said fuel releasable valve while said depressable platform of said fuel lever is depressed to lift said fuel pipe, and that said cover seat has a recess provided subjacent said depressable platform;

a blocking projection being protruded from said depressable platform underside, said blocking projection having an inclined bottom edge;

a catch handle comprising an insert leg extended downwardly to form a J shape member and received in said recess, a top end of said insert leg being enlarged to form a blocking head positioning below said blocking projection of said depressable platform, said blocking head having a tapered outer end to guide the downward movement of said blocking projection; and a resilient element which is received in said recess to support said insert leg and said blocking head outwards to a lock-up position to normally block the downwardly movement of said depressable platform to prevent inadvertent fuel release and actuation by children, however when a depressing force is applied to forcely depress said depressable platform downwards, said blocking projection is forced to prop against said tapered outer end of said blocking head and push said insert leg to move inwardly, but when said depressing force applied on said depressable platform is released, said resilient element supports said insert leg to return to said original lock-up position automatically.

12. A safety lighter as recited in claim 11 wherein said resilient element comprises a supporting piece which is integrally and vertically extended upwardly from a bottom end of said insert leg, in which said supporting piece is abutted against said flint tube inside said recess.

13. A safety lighter as recited in claim 12 wherein a top end of said supporting piece provides a top bent end protrusion to engage with a wall of said flint tube.

* * * * *